US005660543A

United States Patent [19]

Marks et al.

[11] Patent Number: 5,660,543

[45] Date of Patent: Aug. 26, 1997

[54] METHOD AND APPARATUS FOR ENHANCED CONVECTION BRAZING OF ALUMINUM ASSEMBLIES

[75] Inventors: Thomas G. Marks, Depew, N.Y.; Makoto Nishimura, Tokyo, Japan

[73] Assignee: E & M Farication and Welding Corporation, Orchard Park, N.Y.

[21] Appl. No.: 441,080

[22] Filed: May 15, 1995

[51] Int. Cl.[6] ..... F27B 9/04

[52] U.S. Cl. ..... 432/152; 432/25; 432/128; 432/144; 432/242; 432/250

[58] Field of Search ..... 432/21, 25, 128, 432/152, 176, 194, 167, 242, 250, 144, 145, 149, 150; 228/43, 183, 200, 42; 110/173 R

[56] References Cited

U.S. PATENT DOCUMENTS

| | | | |
|---|---|---|---|
| 2,619,341 | 11/1952 | Wallerius | 432/176 |
| 3,304,071 | 2/1967 | Gentry | 432/176 |
| 3,558,112 | 1/1971 | Gaede | 110/173 |
| 3,769,675 | 11/1973 | Chartet | 29/157.3 R |
| 4,029,463 | 6/1977 | Johansson et al. | 432/25 |
| 4,162,141 | 7/1979 | West | 432/152 |
| 4,501,387 | 2/1985 | Hoyer | 228/183 |
| 4,842,185 | 6/1989 | Kudo et al. | 228/183 |
| 5,195,673 | 3/1993 | Irish et al. | 228/18 |
| 5,271,545 | 12/1993 | Boswell et al. | 228/43 |

*Primary Examiner*—Noah P. Kamen

*Attorney, Agent, or Firm*—Gary M. Hartman; Domenica N. S. Hartman

[57] ABSTRACT

A convection furnace is provided for brazing workpieces in a heated recirculating atmosphere, in which the workpieces are positioned within a heating chamber of the furnace and are alternately heated from different sides in a controlled manner such that a substantially uniform temperature is maintained throughout the workpieces while their temperatures are increased by the heated atmosphere, preferably an inert gas. The braze furnace is adapted to intermittently divert the heated atmosphere to one side of the heating chamber, through one or more stacked workpieces, to an opposite side of the heating chamber. As such, a pulsed multi-directional convective atmosphere flow is achieved through the workpieces that promotes a more rapid and uniform heat transfer to the workpieces. As a result, each structure as a unit reaches a suitable braze temperature more effectively and efficiently than previously possible. The enhanced capability of the furnace also enables structures to be stacked on top of each other, thereby substantially increasing furnace throughput.

19 Claims, 3 Drawing Sheets

METHOD AND APPARATUS FOR ENHANCED CONVECTION BRAZING OF ALUMINUM ASSEMBLIES

BACKGROUND OF THE INVENTION

1. Field of the Invention

The present invention generally relates to braze furnaces for brazing of aluminum alloy structures in an oxygen-free atmosphere. More particularly, this invention relates to a convection braze furnace that is configured to include a duct system that directs and pulses a convective recirculated atmosphere through structures to be brazed, so as to create a multidirectional flow that achieves a more uniform temperature throughout the structures.

2. Description of the Prior Art

Heat exchangers are used in various capacities in automotive applications. For example, all automobiles having water cooled engines employ a radiator and a heater core. Automobiles equipped with air conditioning also include an evaporator and a condenser. These products are typically made from aluminum alloys and composed of two spaced header tanks interconnected by flow tubes having cooling fins extending therefrom. A cooling fluid is circulated through the header tanks and flow tubes, and air is directed over the heat exchanger so as to achieve the necessary temperature drop in the fluid.

The header tanks, flow tubes and cooling fins are attached to one another through a joining operation, most often a brazing operation in which the temperature of the assembled components is raised to melt a braze alloy that, upon cooling, rigidly joins the components to form a heat exchanger.

Although there are numerous ways to generate heat energy, heat transfer is basically limited to three modes; radiation, conduction and convection, which can be employed individually or in combination.

Many prior art braze furnaces rely on the exclusive use of radiant heat, whereby heat exchanger assemblies are transported through a ligated muffle tube that utilizes radiate heat energy to raise the temperatures of the assemblies to the braze melting temperature. This method for brazing has proven to be very popular among furnace manufacturers, for it has a very simple design and therefore is very practical to manufacture. Two designs have been primarily employed, one using natural gas burners ganged in a counter-firing manner and located in a cavity between an inner shell and an outer shell enclosing the inner shell. The other design uses electrical elements attached to the exterior of the inner shell. In both cases, the inner shell, or muffle, acts as a radiant surface from which the assemblies, as they lie inside the muffle, receive thermal energy. The outer shell, composed of a refractory material and a protective liner, serves as an insulating barrier to the surroundings.

While acceptable for some applications, radiant furnaces have inherent deficiencies as a result of nonuniform heat transfer to irregularly-shaped articles such as automotive heat exchanger assemblies, rendering such furnaces inefficient to the end user. In particular, assemblies constructed of components having various profile heights and mass densities, as is the case with heat exchangers, receive varying degrees of radiant energy as they lie in or pass through the muffle.

In brazing operations, it is important that all parts of a given assembly come to liquification temperatures at approximately the same time, so as to avoid excessive localized temperatures that can cause melting of the aluminum structure. With radiant braze furnaces, exposure time to the radiant energy source provides the only manner by which uniform assembly braze temperatures can be achieved. With this solution, heat energy, via conductance, is distributed over time. However, a significant disadvantage with this solution is that the cycle time is generally excessively long, necessitating the use of either a batch-type furnace or a continuous-type furnace requiring a large floor space. Such a consequence is unacceptable to most heat exchanger manufacturers for which productivity and manufacturing floor space are important concerns.

Under many circumstances, convection heat transfer offers a more effective and reliable means for achieving uniform temperatures in a given workpiece. Though assemblies having components with varying mass densities receive energy at differing rates, reduced temperature differences are realized in convection heat transfer than are possible by radiant heat transfer. Heat exchanger assemblies can be more readily and efficiently raised to the braze liquification temperature by employing the principles of convection heat transfer, whereby an impeller is used to circulate a suitable atmosphere within the brazing chamber and through the workpieces to be brazed.

Although convection furnaces offer significant advantages, the radiant furnaces have not been abandoned in their entirety because their muffle design offers a simple and effective means of maintaining an inert atmosphere as well as facilitating fabrication. As a result, furnace designs have been developed that incorporate both radiant and convection heat transfer principles. Examples of this type of design in the prior art are disclosed in U.S. Pat. No. 5,271,545 to Boswell et al., U.S. Pat. No. 4,501,387 to Hoyer, and U.S. Pat. No. 3,769,675 to Chartet. Furnace designs of the type represented by the above prior art have proven to be an improvement over radiation furnaces, and are widely used throughout the heat exchanger industry.

Attempts to design and build a furnace dependent solely on the principles of convection heat transfer have also been achieved. An example is the convection furnace taught by U.S. Pat. No. 5,195,673 to Irish et al. However, a shortcoming with the teachings of Irish et al. and many radiation-convection furnaces is that the heating atmosphere is directed through the workpiece, from top to bottom, such that nonuniform temperatures are created within the workpiece. A significant consequence is that the productivity of the equipment is limited to a single layer of parts to be brazed if uniform temperatures are to be achieved.

In contrast, the teachings of Chartet and U.S. Pat. No. 4,842,185 to Kudo et al. achieve a bidirectional flow through a heat exchanger by rotating the heat exchanger, thereby alternating the surfaces of the heat exchanger subjected to direct impingement by the heated atmosphere. Unfortunately, such teachings considerably complicate the construction of a braze furnace, adding cost to the furnace while significantly reducing throughput capacity.

Another method for achieving bidirectional heating of a heat exchanger is disclosed by Hoyer, which relies on a rotating heated atmosphere to flow upwardly through a first heat exchanger and then downwardly through a second and trailing heat exchanger. Unfortunately, uniform heating of the heat exchangers is difficult to achieve with this method in that more than two heat exchangers cannot be simultaneously heated in a uniform manner without considerably increasing the size of the furnace. Furthermore, the heat exchangers are directly subjected to radiant heat from heating elements located within the brazing chamber, which inherently causes localized heating at one surface of each heat exchanger. Finally, the braze chamber must be sufficiently large to accommodate radially-spaced stationary blades that are required to obtain the desired rotational flow of the heated atmosphere.

From the above, it can be seen that the full advantage for convection brazing has not been realized in the prior art. Furthermore, prior art attempts to braze solely by the convection method are only slightly more efficient than braze furnaces that incorporate the muffle/convection design. For example, during the brazing process, unidirectional, constant flow convection heat transfer methods tend to cause unnecessarily high localized temperatures within assemblies composed of components with differing densities. Another significant shortcoming is that the prior art does not make possible the circulation of a hot gas atmosphere within a braze furnace in a manner that enables the brazing of multiple layers of workpieces, i.e., workpieces stacked on a rack or conveyor. Therefore, although significant improvements have been achieved in obtaining uniform temperatures throughout a workpiece through the use of convection heat transfer methods, further improvements would be highly desirable.

SUMMARY OF THE INVENTION

It is an object of this invention to provide a furnace capable of operating to achieve substantially uniform temperatures throughout workpieces being heated within the furnace.

It is a further object of this invention that such a furnace transfer heat to the workpieces primarily by convection.

It is still a further object of this invention that such a furnace be particularly adapted to braze heat exchanger assemblies.

It is another object of this invention that the convection heat transfer mode of the furnace enable the simultaneous brazing of stacked heat exchanger assemblies.

It is still another object of this invention that such a furnace be capable of selectively directing heated gases to opposite sides of a heat exchanger, such that a pulsing action is generated with the heating gases.

In accordance with a preferred embodiment of this invention, these and other objects and advantages are accomplished as follows.

According to the present invention, there is provided a convection furnace of the type suitable for brazing aluminum workpieces in a controlled atmosphere. The furnace includes a heating chamber adapted to receive an article for heating, a supply duct associated with the heating chamber, means for delivering a heated gas to the supply duct, and a pair of ducts disposed on opposite sides of the heating chamber, each of which is adapted to direct the heated gas toward the center of the heating chamber. The braze furnace further includes a device for selectively diverting flow of the heated gas to one of the pair of ducts, such that the heated gas is alternately delivered to the pair of ducts so as to cause the flow of heated gas toward the center of the heating chamber to be pulsed. As a result, an article received in the heating chamber is alternately heated from opposite sides in a controlled manner such that a substantially uniform temperature is maintained throughout the article while the temperature of the article is increased by the heated gas. More specifically, the diverting device directs the circulating atmosphere from one side of the brazing chamber, through the enclosed articles, to the other side of the brazing chamber. The diverting device can be employed to achieve a pulsed alternating unidirectional, pulsed bidirectional, or pulsed multidirectional convective atmosphere flow through the articles.

Most preferably, the heating chamber is a substantially sealed housing defining a controlled atmosphere brazing chamber. The brazing chamber is preferably one of several heated sections of the furnace, with sealing devices disposed between adjacent sections to separate and define entrance, preheat, brazing and exit chambers. In addition, the furnace is preferably equipped with conveyors for transporting articles through its various chambers.

A significant advantage of the present invention is that the furnace overcomes shortcomings of the prior art by providing a pulsating atmosphere to the sides of the workpieces, such that stacked workpieces can be brazed simultaneously at a substantially uniform temperature. As a result, a brazing operation can be more efficiently accomplished at higher production levels. In contrast, prior art braze furnaces do not permit the brazing of stacked workpieces, nor do they achieve a uniform temperature throughout the workpieces.

An additional advantage of this invention is that the furnace of this invention enables a convected atmosphere to be selectively and alternatingly diverted to opposite sides of a workpiece, so as to further achieve a more uniform temperature gradient. As such, though portions of workpieces having lower densities receive energy at a faster rate that those of higher densities, the pulsed alternating convection atmosphere achieved with the furnace enables portions having lower densities to transfer energy to portions having higher densities. As a result, an assembly of various sized components with differing densities will reach a desired temperature much more effectively, uniformly and efficiently than that possible with furnaces of the prior art.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawings, in which.

DETAILED DESCRIPTION OF THE PREFERRED EMBODIMENT

A convection braze furnace assembly is provided for brazing aluminum workpieces in a controlled heated atmosphere, in which workpieces within a brazing chamber of the furnace are alternately heated from opposite sides in a controlled manner such that a substantially uniform temperature is maintained throughout the workpieces while their temperatures are increased by a heated gas. More specifically, the braze furnace is adapted to divert a heated circulating atmosphere to one side of the heating chamber, through the one or more stacked workpieces, to the other side of the heating chamber, so as to achieve a pulsed multidirectional convective atmosphere flow through the workpieces.

While the invention will be described in detail with respect to aluminum heat exchanger assemblies, the braze furnace of this invention is well suited for uniformly heating various articles, workpieces, assemblies and subassemblies. Furthermore, the terms "assemblies" and "subassemblies" cover a wide variety of manufactured products, including heat exchangers, fan propellers, manifolds, and various other products, and including various aluminum and aluminum alloy products. Accordingly, the present invention is not limited to the brazing of aluminum heat exchangers, nor to a braze furnace for brazing aluminum heat exchangers.

Figure 1:
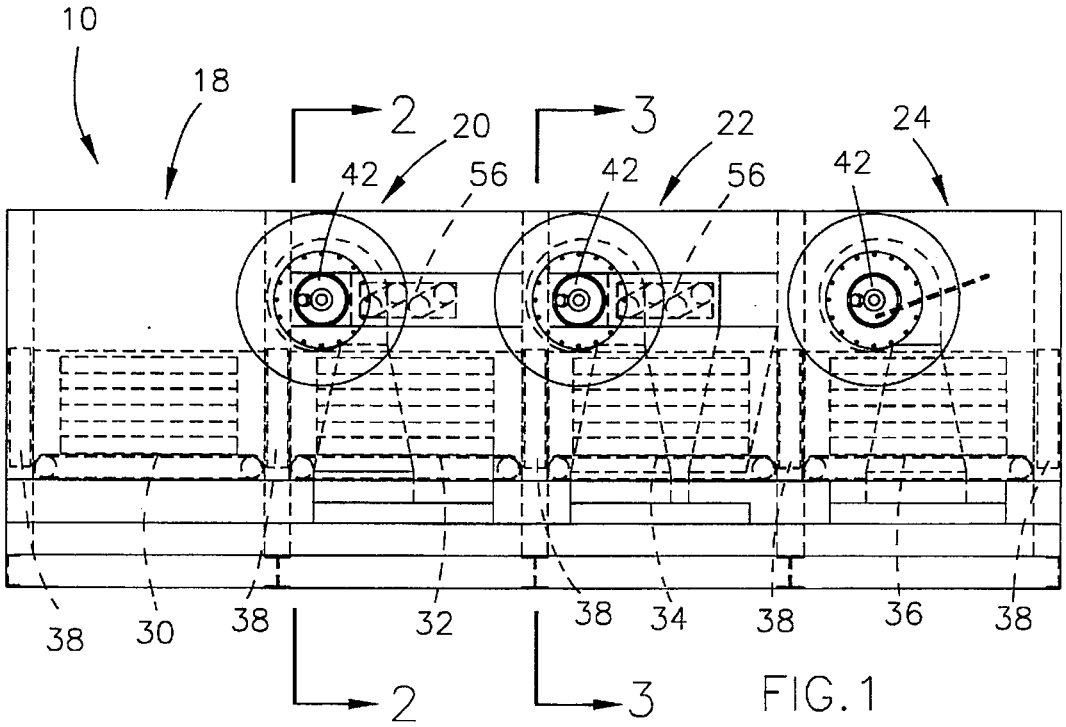
FIG. 1 is a side view of a convection furnace configured in accordance with a preferred embodiment of the present invention.
Figure 2:
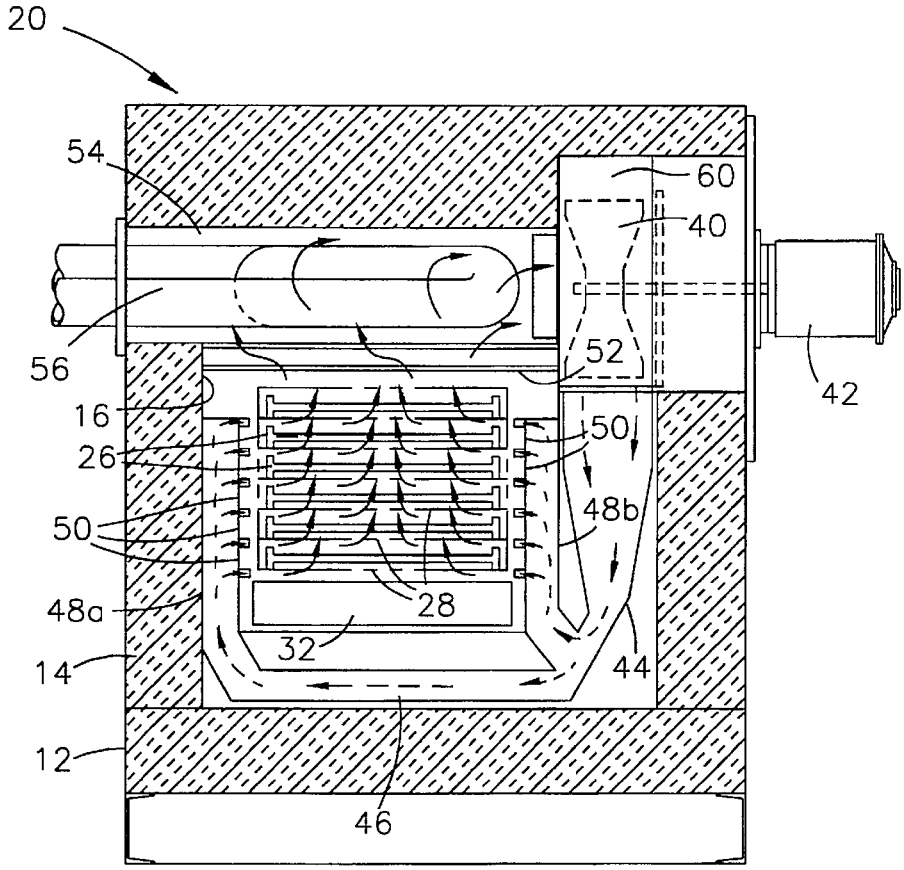
FIGS. 2 and 3 are cross-sectional views of the furnace of FIG. 1 along lines 2—2 and 3—3, respectively.

Referring now in detail to the Figures, there is illustrated in FIG. 1 a side view of an improved convection braze furnace 10 which is constructed in accordance with the principles of the present invention. The furnace 10 is generally adapted to include a number of heating stages, such that the furnace 10 may be considered a brazing and annealing furnace. As shown in FIG. 2, the furnace 10 is generally formed to have a sheet metal outer shell 12 that is lined with a layer of insulating material 14 on its interior surface.

As also shown in FIG. 2, the furnace 10 further includes a continuous, gas-impervious interior chamber 16. As illustrated in FIG. 1, the interior chamber 16 is divided into four sections, with adjacent sections being separated by doors 38. Starting with the section nearest the entrance of the furnace 10, the sections preferably include a purge section 18, a preheat section 20, a braze section 22 and a cooldown section 24.

Figure 5:
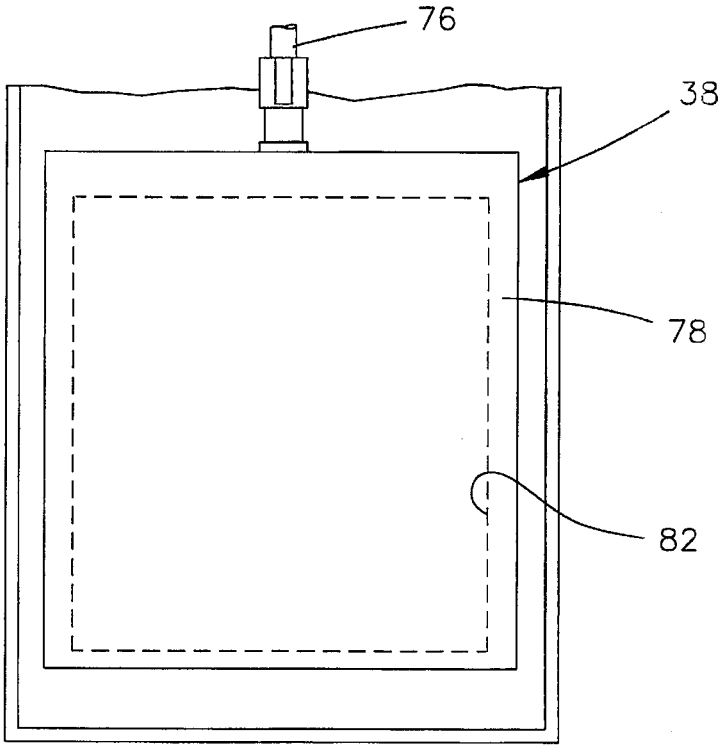
FIG. 5 shows the construction of a furnace door employed in accordance with the preferred embodiment of the furnace of FIG. 1.
Figure 6A:
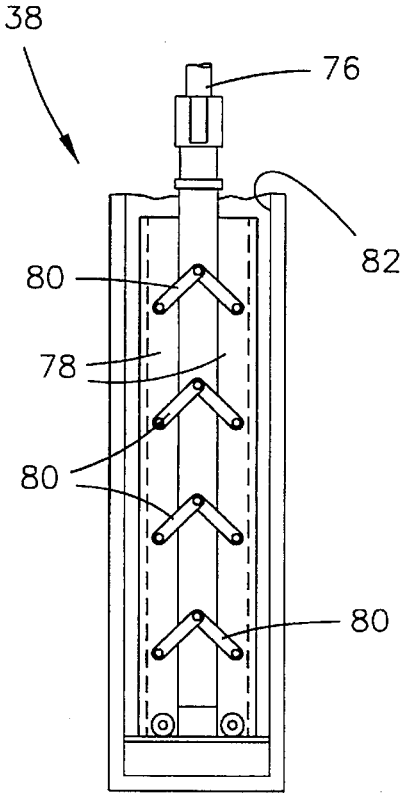
FIGS. 6*a* and 6*b* show the furnace door of FIG. 5 in contracted and expanded positions, respectively.
Figure 6B:
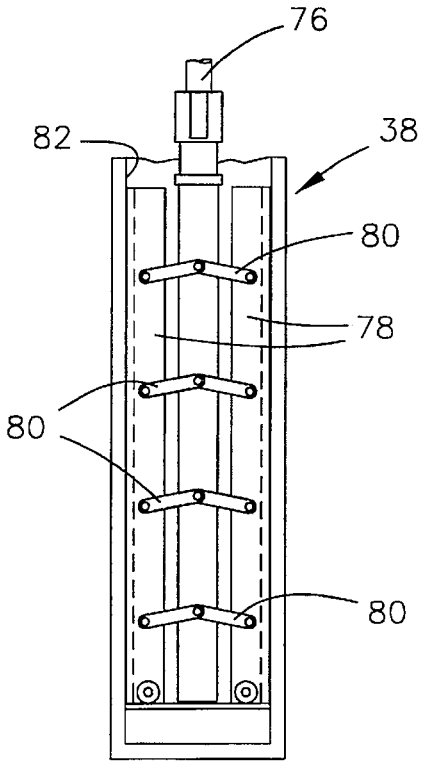

The doors 38 are located at the entrance and exit to the furnace 10, as well as between each of the sections 18 through 24. Each door 38 is preferably expandable, as shown in greater detail in FIGS. 5, 6*a* and 6*b*. As shown in FIG. 5, each door 38 is received within a door opening 82 defined between each pair of adjacent sections 18 through 24 of the furnace, as well as at the entrance and exit of the furnace 10. As can be more readily seen in FIGS. 6*a* and 6*b*, each door 38 is composed of a pair of panels 78 interconnected along opposite edges by a number of toggles 80. The door 38 shown in FIG. 6*a* is collapsed so as to permit the door 38 to be readily displaced upwardly, thereby enabling workpieces 26 supported on racks 28 (FIGS. 2 through 4) to be transported by conveyors 30 through 36 (FIGS. 1 through 4) through the door opening 82. Once the door 38 is returned to close the opening 82, an actuator 76 connected to the toggles 80 is actuated, causing the toggles 80 to expand the panels 78 outward so as to form a substantially gas-tight seal with the door opening 82, as shown in FIG. 6*b*.

The doors 38 and their operation are highly advantageous to the operation of the furnace 10, in that the doors 38 make possible an enhanced brazing atmosphere because the improved sealing capability enables a very low dew point within the furnace 10. Those skilled in the art will appreciate that low dew points promote the aesthetic appearance of brazed assemblies. The sealing capability made possible by the doors 38 of this invention has not been achieved with prior art door designs.

Figure 3:
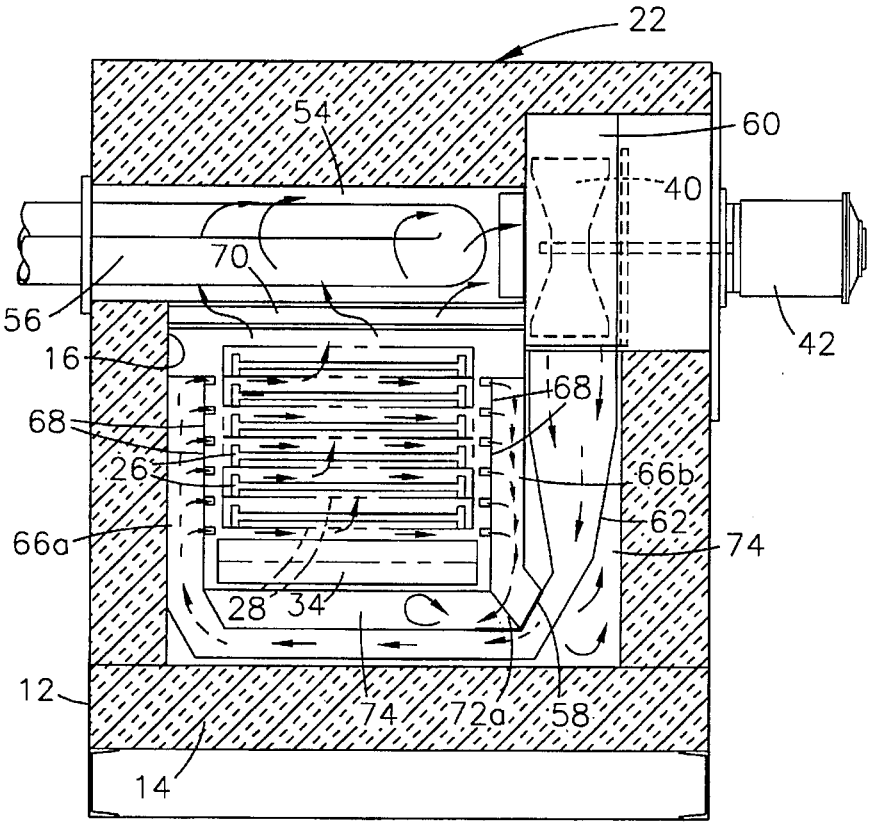
Figure 4:
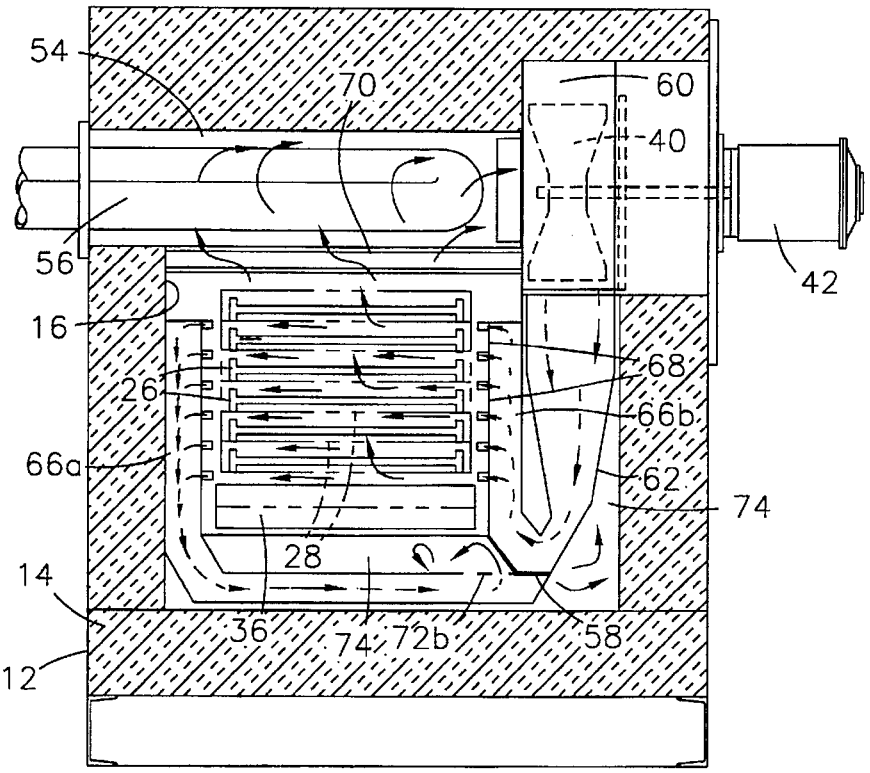
FIG. 4 is a counterpart view to FIG. 3, in which convection flow through the braze section of the furnace has been altered by a diverter valve.

A number of stacked job racks 28 are shown in phantom in FIG. 1, and in greater detail in FIGS. 2 through 4. As shown in FIG. 1, each rack 28 is supported on a corresponding one of the conveyors 30 through 36. Although the Figures show stacks of six racks 28, each of which is adapted to support a workpiece 26 as shown in FIGS. 2 through 4, it will be apparent to those skilled in the art that more racks 28 and/or racks 28 supporting more than one workpiece 26 could also be employed. The racks 28 are designed in such a manner as to create a space between each workpiece 26 for a convected atmosphere to flow. After the door 38 at the entrance to the furnace 10 is opened, the stacked job racks 28 are indexed by an external conveyer (not shown), and are then received by the conveyer 26 within the purge section 18 as the entrance door 38 closes.

Since the interior chamber 16 is continuous and gas-impervious, and the expandable doors 38 at either end of the purge section 18 collectively serve as sealing devices from the outside atmosphere, the purge section 18 can be purged such that the existing outside atmosphere within the purge section 18 is replaced, via a pressurized inert gas supply and atmosphere exhaust port (not shown), with a process gas, such as nitrogen or an exothermic gas. After the desired atmosphere has been established using appropriate control mechanisms (not shown) that are well known in the art, the door 38 between the purge section 18 and the preheat section 20 is opened, and the job racks 28 within the purge section 18 are indexed via the conveyors 30 and 32 into the preheat section 20 of the furnace 10, where the racks 28 come to rest as the door 38 closes.

The atmosphere within the preheat section 20 is controlled and maintained in a manner similar to that described for the purge section 18. Referring now to FIG. 2, the preheat section 20 is shown as defining a path for a recirculated convected atmosphere. An impeller 40, enclosed within a housing 60 and powered by a motor 42, is provided within the path for pressurizing the atmosphere within the path. The impeller 40 directs the atmosphere through a main duct 44 to a lower duct 46 and a pair of side plenums 48*a* and 48*b*. Each plenum 48*a* and 48*b* is equipped with openings established by louvers 50 that divide and direct the atmosphere between each job rack 28. The atmosphere is disbursed through the workpieces 26, causing the atmosphere's energy level to drop, after which the atmosphere is returned through a baffled and louvered divider panel 52 to a return plenum 54. A heat exchanger 56 housed within the plenum 54 replaces the energy lost by the atmosphere, after which the atmosphere is recirculated to the impeller 40, from which the above cycle is repeated.

The baffled and louvered divider panel 52 noted above serves two purposes. The first is to better distribute the atmosphere as it returns to the plenum 54 in order to maximize the effect of the heat exchanger 56. The second purpose is to shield the workpieces 26 from radiant energy emitted by the heat exchanger 56. As such, the preheat section 20 is configured to operate solely on the basis of convection heat transfer, and shields the workpieces 26 from thermal energy radiated by the heat exchanger 56.

It is generally the intent of the preheat section 20 to raise the temperature of the workpieces 26 from ambient to within about 200° F. to 300° F. of the desired brazing temperature. After this is accomplished and a set interval has elapsed, the door 38 located between the preheat and braze sections 20 and 22 is opened and the workpieces 26 are indexed into the braze section 22 with the conveyors 32 and 34. The workpieces 26 then come to rest and the door 38 closes.

The atmosphere within the braze section 22 is controlled and maintained in essentially the same manner as is in the purge and preheat sections 18 and 20. The braze section 22 is illustrated in greater detail in FIG. 3, which illustrates the preferred manner in which the desired pulse operation of the furnace 10 is achieved. An impeller 40, essentially identical to the impeller shown in FIG. 2 and enclosed in a similar housing 60, serves to pressurize the internal atmosphere of the braze section 22 and direct the atmosphere through a main duct 62 to a diverter valve 58, shown in the Figures as having a V-shaped cross-section. The diverter valve 58 may be actuated through a linkage to the exterior of the furnace 10, and powered by either an electric motor, or by a hydraulic or pneumatic piston, though it is foreseeable that the diverter valve 58 could be actuated by other means.

As represented in FIG. 3, the diverter valve 58 directs the atmosphere into a lower duct 64 and then one (66*a*) of two plenums 66*a* and 66*b*. Each plenum 66*a* and 66*b* is provided with openings formed by dampers 68 that divide and direct the atmosphere between the job racks 28. As the convected atmosphere flows through the workpieces 26 and racks 28, the atmosphere's energy level is decreased. A portion of the atmosphere may be deflected to flow upwardly through an adjustable damper opening 70 above the workpieces 26, and thereafter into a return plenum 54 housing a heat exchanger 56.

Because the return plenum 54 is upstream of the impeller 40, the return plenum 54 is under a negative pressure. Most of the atmosphere continues through the workpieces 26, between the racks 28 and into the opposite plenum 66*b*. As illustrated in FIG. 3, the plenum 66*b* is under a negative pressure due to the position of the diverter valve 58, which causes an aperture 72*a* in the plenum 66*b* to be exposed. The aperture 72*a* subjects the plenum 66*b* to the negative pressure of the return plenum 54 via a secondary duct 74, which is generally defined by the remainder of the braze section 22 not occupied by the main duct 62, lower duct 64, plenums 66*a* and 66*b*, workpieces 26 or racks 26. Accordingly, a majority of the atmosphere is transported to the return plenum 54 through the secondary duct 74, where energy is transferred from the heat exchanger 56 to the atmosphere prior to the atmosphere being returned to the impeller 40.

The convected atmosphere continues to be circulated along the above-described path, as designated by the arrows in FIG. 3, until the diverter valve 58 is actuated to the position shown in FIG. 4. The recirculation path of FIG. 4 is also represented by arrows. As before, the impeller 40 pressurizes and directs the energy laden atmosphere through the main duct 62 to the diverter valve 58. In its alternate position, the diverter valve 58 directs the atmosphere into the plenum 66*b*, where it is divided by the louvers 68 to flow between the job racks 28. The convected atmosphere is directed through the workpieces 26, causing the energy level of the atmosphere to drop.

As before, a portion of the atmosphere flows upwardly through the adjustable damper opening 70 to the return plenum 54. However, most of the atmosphere continues through the workpieces 26 and between the racks 28, and thereafter into the opposite plenum 66*a*. With the diverter valve 58 in the position shown in FIG. 4, the plenum 66*a* is under a negative pressure because an opening 72*b* exposed by the diverter valve 58 subjects the plenum 66*a* to the negative pressure, via the secondary duct 74, of the return plenum 54. Once in the return plenum 54, the atmosphere again receives energy from the heat exchanger 56 and is returned to the impeller 40 for further recirculation.

From the above, it is apparent that, by toggling the diverter valve 58 between the positions shown in FIGS. 3 and 4 over a number of appropriately timed intervals, a more uniform workpiece temperature is achieved. Furthermore, a more uniform temperature gradient is achieved throughout the entire braze cycle. More specifically, when the convected atmosphere is applied from left to right, as shown in FIG. 3, a corresponding temperature gradient develops in the workpieces 26. That is, the left-most portions of the workpieces 26 receive more thermal energy than do the right-most portions. If the applied convected atmosphere were to remain on the workpieces 26 for an extended period of time, the temperature gradient would become more pronounced, even though some conduction occurs through the workpieces 26.

However, in accordance with the present invention, a more constant and uniform temperature gradient is readily achieved by pulsing the convected atmosphere flow across the workpieces 26 through intermittent actuation of the diverter valve 58. In effect, by subjecting the workpieces 26 to limited bursts of energy over timed intervals, the thermal energy level becomes more uniformly distributed as a result of conduction, yielding a reduced temperature gradient as the workpieces 26 approach the desired brazing temperature.

The advantageous effect of employing a pulsed atmosphere is further enhanced by altering the flow direction of the convected atmosphere, as shown between FIGS. 3 and 4. When the direction is changed, the energy level at one side of the workpieces 26 is conducted toward the center of each workpiece 26, while the opposite sides of the workpieces 26 are being heated. By changing the direction of the convected atmosphere over appropriately timed intervals, the average temperature of the workpiece 26 increases while the resulting temperature gradient within each workpiece 26 decreases, until a very nearly uniform temperature is achieved as the workpieces 26 approach the desired brazing temperature.

Furthermore, using the above principle of a pulsed and redirected convected atmosphere, the present invention makes possible the heating of workpieces 26 that are stacked on top of each other, as shown in the Figures, thereby increasing furnace capacity to an extent not possible with prior art furnaces. Alternatively, the workpieces 26 could be oriented vertically in the furnace 10, as opposed to the horizontal orientation shown in the Figures. A vertical orientation may be advantageous under some circumstances to increase productivity, or may be useful when brazing components whose braze joints would benefit from the assistance of gravity on the joints during the brazing operation.

After the braze cycle is completed, the door 38 located between the braze section 22 and the cooldown section 24 is opened and the workpieces 26 are indexed into the cooldown section 24 with the conveyors 34 and 36. Once the workpieces 26 are properly positioned, the doors 38 of the cooldown section 24 close and the cooldown cycle begins. The atmosphere of the cooldown section 24 is recirculated in essentially the same manner as in the preheat section 20, with a water cooled heat exchanger being employed to cool the atmosphere. As the cooled atmosphere is passed between the job racks 28, heat is transferred from the workpieces 26 to the atmosphere, causing a temperature decrease in the workpieces 26. After an appropriately timed interval, the door 38 located at the exit to the furnace 10 opens, and the conveyor 36 indexes the workpieces 26 onto an accumulating conveyor (not shown), completing the furnace operation.

From the foregoing detailed description, it can be seen that the present invention provides an improved convection furnace for brazing and/or annealing a workpiece, such as a heat exchanger assembly or subassembly. More specifically, a significant advantage of the present invention is that the braze furnace 10 overcomes shortcomings of the prior art by providing a pulsating atmosphere to the sides of the workpieces, such that stacked workpieces can be brazed simultaneously at a substantially uniform temperature. As a result, a brazing operation can be more efficiently accomplished at higher production levels.

In contrast, prior art braze furnaces do not permit the brazing of stacked workpieces, nor do they achieve a uniform temperature throughout the workpieces. Although it may be possible to operate a conventional furnaces so as to achieve a more uniform temperature in workpieces having complicated geometries, extremely long furnaces would be required to prevent localized melting of the workpieces if braze materials are employed that have a melting point very dose to (often within about 100° F. of) the melting point of aluminum.

An additional advantage of this invention is that the pulsed convection atmosphere achieved with the furnace 10 enables regions of workpieces having lower densities, and therefore prone to heating relatively quickly, to transfer energy to regions having higher densities. As a result, an assembly of various sized components with differing densities can be heated to a desired braze temperature much more effectively and efficiently than that possible with furnaces of the prior art. The furnace 10 of this invention enables a convected atmosphere to be selectively diverted to opposite sides of a workpiece, so as to further achieve a more uniform temperature gradient.

In addition, the use of individual timed and intermittent conveyors within each section, in cooperation with the expandable sealing doors, enables the use of dedicated air/oxygen purge cycles and shorter overall furnace lengths. As a result, the atmosphere of each section can be tailored for the particular operation performed in a section, thereby enhancing the overall operation and efficiency of the furnace 10.

While our invention has been described in terms of a preferred embodiment, it is apparent that other forms could be adopted by one skilled in the art. For example, the furnace 10 could be employed for operations other than brazing, and the number and type of sections to the furnace could differ from that shown. In addition, the construction of the duct system could be altered considerably and yet achieve the intended operational characteristics, such as through the use of ducts that create additional flow directions within the multidirectional recirculation system, or through the use of multiple opposing fans within each section of the furnace 10 in lieu of the duct system shown in the Figures. Accordingly, the scope of our invention is to be limited only by the following claims.

The embodiments of the invention in which an exclusive property or privilege is claimed are defined as follows:

1. A convection furnace comprising:

a heating chamber adapted to receive an article for heating, the heating chamber comprising an entrance, an exit, first means disposed in the entrance for engaging and sealably closing the entrance, and second means disposed in the exit for engaging and sealably closing the exit;

first means in fluidic communication with the heating chamber for transporting a heated gas through the interior of the heating chamber;

second means in fluidic communication with the heating chamber for transporting the heated gas through the interior of the heating chamber, the second transporting means being in fluidic communication with the first transporting means through the heating chamber;

means for delivering a heated gas to the first and second transporting means; and means for alternately and selectively diverting flow of the heated gas to the first and second transporting means so as to provide first and second modes, the first mode being characterized by the heated gas flowing from the first transporting means through the interior of the heating chamber to the second transporting means, the second mode being characterized by the heated gas flowing from the second transporting means through the interior of the heating chamber to the first transporting means, whereby the heated gas is alternately pulsed in at least two different directions through the heating chamber.

2. A convection furnace as recited in claim 1 further comprising;

a heating element disposed adjacent the heating chamber; and means for shielding the interior of the heating chamber from thermal energy radiated by the heating element.

3. A convection furnace as recited in claim 1 wherein the first and second transporting means comprise ducts.

4. A convection furnace as recited in claim 3 wherein the ducts are oppositely disposed within the heating chamber.

5. A convection furnace as recited in claim 3 wherein each of the ducts has multiple openings adapted to direct the heated gas toward the interior of the heating chamber.

6. A convection furnace as recited in claim 1 wherein the diverting means comprises a diverting valve upstream of the first and second transporting means.

7. A convection furnace as recited in claim 1 further comprising means for supporting and transporting the article within the heating chamber.

8. A convection furnace as recited in claim 7 wherein the supporting and transporting means is adapted to simultaneously support and transport a plurality of stacked articles through the heating chamber.

9. A convection furnace as recited in claim 1 wherein each of the first and second closing means comprises:

an actuator having an axis of actuation; and a pair of panels pivotably attached to the actuator such that the pair of panels are displaced away from each other when the actuator is pivoted in a first direction along the axis of actuation, and such that the pair of panels are displaced toward each other when the actuator is pivoted in an opposite direction along the axis of actuation.

10. A convection braze furnace comprising:

a heating chamber adapted to receive an article for heating, the heating chamber comprising an entrance, an exit, first means disposed in the entrance for engaging and sealably closing the entrance, and second means disposed in the exit for engaging and sealably closing the exit;

a heating element disposed adjacent the heating chamber;

means for shielding the interior of the heating chamber from thermal energy radiated by the heating element;

a supply duct associated with the heating chamber;

means for delivering a heated gas to the supply duct;

a pair of ducts disposed on opposite sides of the heating chamber, each of the pair of ducts being adapted to direct the heated gas toward the interior of the heating chamber;

a return duct; and means for selectively diverting flow of the heated gas to one of the pair of ducts so as to provide first and second modes, the first mode being characterized by the heated gas flowing from a first duct of the pair of ducts through the interior of the heating chamber and then through a second duct of the pair of ducts to the return duct, the second mode being characterized by the heated gas flowing from the second duct through the interior of the heating chamber and then through the first duct to the return duct;

whereby an article received in the heating chamber is alternately heated from opposite sides such that a substantially uniform temperature is maintained throughout the article while the temperature of the article is increased by the heated gas.

11. A convection braze furnace as recited in claim 10 wherein the shielding means comprises a damper through which the heated gases flow from the heating chamber to the heating element.

12. A convection braze furnace as recited in claim 10 further comprising means for supporting and transporting the article within the heating chamber.

13. A convection braze furnace as recited in claim 12 wherein the supporting and transporting means is adapted to simultaneously support and transport a plurality of stacked articles through the heating chamber.

14. A convection braze furnace as recited in claim 13 wherein the supporting and transporting means comprises:

a conveyor disposed within the heating chamber; and a plurality of racks supported on the conveyor, each of the plurality of racks being adapted to support at least one of the plurality of stacked articles.

15. A convection braze furnace as recited in claim 13 wherein each of the pair of ducts comprises a vertical array of apertures, each of the apertures being adapted to direct the heated gas toward a corresponding one of the plurality of stacked articles.

16. A method for heating an article by convection heat transfer, the method comprising the steps of:

providing a heating chamber comprising an entrance, an exit, first means disposed in the entrance for engaging and sealably closing the entrance, and second means disposed in the exit for engaging and sealably closing the exit;

positioning the article within the heating chamber through the entrance and then closing the entrance with the first closing means;

shielding the article from thermal radiation emitted by a heating element associated with the heating chamber;

alternately and selectively diverting flow of a heated gas through the interior of the heating chamber between oppositely-disposed ducts such that the heated gas is pulsed from a first of the ducts through the interior of the heating chamber and out a second of the ducts and then pulsed from the second of the ducts through the interior of the heating chamber and out the first of the ducts, such that the article is alternately heated from different sides such that a substantially uniform temperature is maintained throughout the article while the temperature of the article is increased by the heated gas; and then removing the article from the heating chamber through the exit.

17. A method as recited in claim 16 wherein the positioning step comprises simultaneously transporting a plurality of stacked articles into the heating chamber.

18. A method as recited in claim 17 Wherein the diverting step comprises directing the heated gas between the plurality of stacked articles.

19. A method as recited in claim 16 wherein the diverting step is performed by a valve disposed upstream of the ducts.

* * * * *